United States Patent [19]

Reid

[11] 3,972,468

[45] Aug. 3, 1976

[54] REFRIGERATED DOUGH CAN

[75] Inventor: Francis R. Reid, Minneapolis, Minn.

[73] Assignee: The Pillsbury Company, Minneapolis, Minn.

[22] Filed: Nov. 28, 1975

[21] Appl. No.: 635,818

[52] U.S. Cl. ..... 229/51 BP; 229/4.5; 426/128

[51] Int. Cl.[2] ..... B65D 81/34; B65D 83/00

[58] Field of Search ..... 229/51 BP, 3.5 R, 4.5; 426/128

[56] References Cited

UNITED STATES PATENTS

| | | | |
|---|---|---|---|
| 2,793,126 | 5/1957 | Fienup et al. | 229/51 BP |
| 2,793,127 | 5/1957 | Geist et al. | 229/51 BP |
| 2,891,714 | 6/1959 | Vallas | 229/51 BP |
| 2,901,162 | 8/1959 | Vallas | 229/51 BP |
| 3,174,676 | 3/1965 | Stump et al. | 229/51 BP |
| 3,366,493 | 1/1968 | Stump | 229/51 BP X |
| 3,933,302 | 1/1976 | Reid et al. | 229/51 BP X |

*Primary Examiner*—Davis T. Moorhead
*Attorney, Agent, or Firm*—James V. Harmon; Michael D. Ellwein

[57] ABSTRACT

A spiral wound can is described which comprises a body layer made of kraft paper or a relatively heavy fiberboard layer lined within by an oil and moisture impermeable barrier formed from a laminate of aluminum foil and paper. The body layer includes a helically extending separation line or butt joint held together by a label and a reinforcing tensile element in strip form. The liner has a peelable or separable adhesive joint between its helically extending edges aligned with and underlying the butt joint so that the butt joint will open as the edges of the liner peel apart after the reinforcing strip is removed. A discrete label covers both the reinforcing strip and the bodystock and is bonded to the bodystock by at least two broken or unbroken bonds of adhesive on opposite sides of the reinforcing strip. A circumferentially extending collar cut is made through the label and reinforcing strip to facilitate their removal. The reinforcing strip is preferably bonded more strongly to the label than to the body and is removed when the label is removed.

10 Claims, 4 Drawing Figures

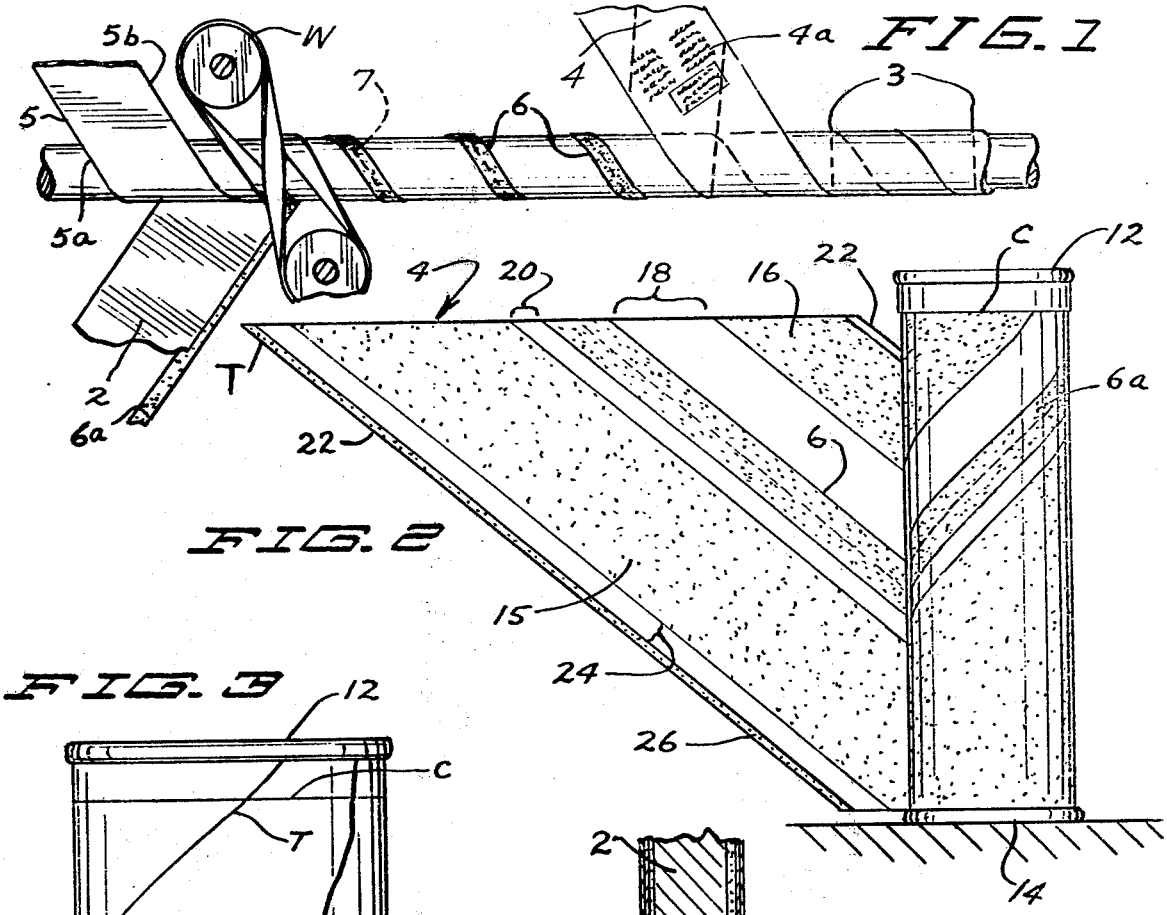
FIG. 1
FIG. 2
FIG. 3
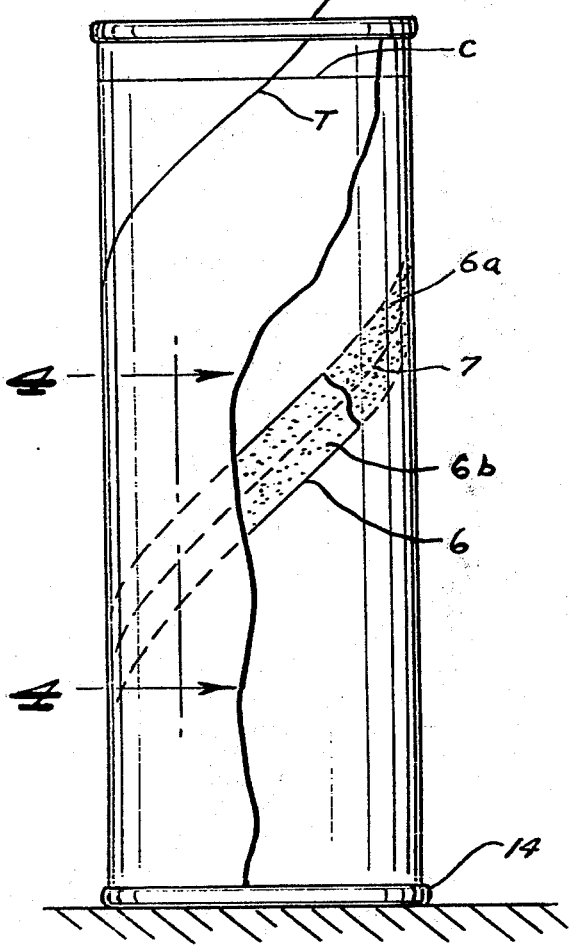
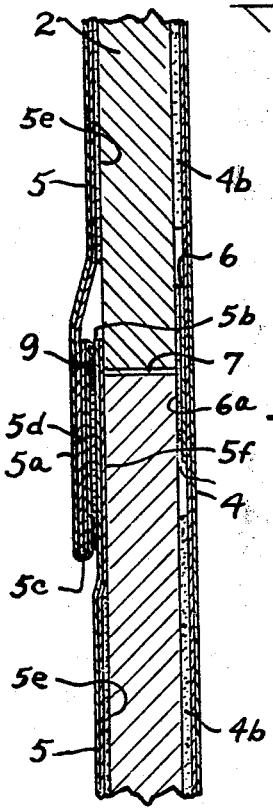
FIG. 4

REFRIGERATED DOUGH CAN

FIELD OF THE INVENTION

The invention relates to dough cans and particularly to opening features for such cans.

THE PRIOR ART

A large number of pressurized cans for refrigerated dough products have been made under U.S. Pat. Nos. 2,793,126 and 2,793,127 and 3,144,193. These patents describe helically wound fiber cans composed of a relatively thick central fiberboard bodystock layer covered on the inside and outside by helically wound liner and label layers. The label is entirely removed before the can is to be opened. The can is then struck against a solid object causing the liner to split along a separation line defined by a helical butt joint in the fiber bodystock that extends the entire length of the can.

U.S. Pat. No. 3,366,493 describes a helically wound fiber can superficially similar to the present invention in that it is provided with a reinforcing strip bonded over a helical butt joint and a label. However, the reinforcing strip is never removed and the can when it is opened, opens along a series of perforations that extend parallel to and spaced from the butt joint. The problem with this container is that it is opened in two stages; label removal followed by striking the can. Moreover, the perforated separation line must be relatively difficult to rupture if the container is to have the requisite strength. While the can could be made easier to open by reducing the strength of the perforation line, the cans would then be more likely to burst prematurely either on the shelves or during the opening process which is, of course, a substantial disadvantage. Accordingly, a compromise must be made between a perforation line of relatively low strength which is easy to open but which might burst prematurely and a higher strength perforation line which securely retains the can intact but requires possibly two to three hard raps against a solid edge to be opened. In either case, a substantial safety margin has to be provided to allow for manufacturing tolerances in the liner, paperboard, bodystock and the precise dimensions of the perforation line including the changes from time to time in the length and width of the perforation cuts.

Other cans have been provided with reinforcing strips among these being U.S. Pat. Nos. 3,510,050 and 3,147,902 in which the strips are not removed at any time. U.S. Pat. No. 3,035,753 describes a helically wound fiber container for dough products with a removable reinforcing strip in which the label is not to be removed from the can but is instead torn by the reinforcing strip when the strip is removed.

U.S. Pat. No. 3,174,676 describes a dough can of the kind with which applicant is concerned wherein a reinforcing strip is provided over the helically extending butt joint and the reinforcing strip is removed when the label is removed. The difficulty with this container is that two steps are required in the opening operation, first, the removal of the label and reinforcing strip and second, the rupturing or fracturing of the helically extending seam by striking the can against something solid. A primary objective of the present invention is to provide a can which is (a) just as strong as present cans of the general kind described and (b) will open essentially by itself and without manipulation by the user manually or otherwise following the removal of the label and reinforcing strip. This cannot be done with the patented containers since the seam must be fractured. Fracturing the container is usually accomplished by striking the can against a solid object such as the edge of a table or by pressing a spoon against the seam. The performance of these steps is undesirable not only because of the extra time and energy required to perform them but also because the container sometimes fails to open when struck against a solid object in accordance with the directions. In that case, the user is forced to strike it again and again against the table edge. This occasionally causes the can to become sufficiently weak that the end flies off with a rather loud popping noise. This is decidedly not the way in which the can was designed to be opened. Moreover, removing the biscuits through the end of the can causes them to become misshaped and lose volume when baked.

THE OBJECTS

The primary objects of this invention are to provide an improved fiber can for dough products with the following characteristics and advantages: (a) provision for assuring that the can is as strong as present cans during storage and for enabling the can to be opened in a single manipulative step to avoid the requirement for striking the can against a solid object to open it or opening it with a spoon as with cans now in commercial use, (b) an effective provision for weakening the can wall as the label is removed so that the can is self-opening when it contains dough under pressure, (c) provision for utilizing light weight labels if desired which provide requisite printing surfaces for photographs and descriptive legends but are less expensive than standard labels, (d) a provision for reinforcing the butt joint during the can winding operation to provide the strength required during winding and (e) the provision of a single step opening can which is yet relatively easy to produce on existing commercially available equipment.

THE FIGURES

FIG. 1 is a semi-diagramatic plan view illustrating a preferred method used in forming cans in accordance with the invention.

FIG. 2 is a side elevational view of a finished can showing the label and reinforcing strip partially removed.

FIG. 3 is a side elevational view of the can embodying the invention on an enlarged scale partially broken away.

FIG. 4 is a greatly magnified vertical sectional view taken on line 4—4 of FIG. 3.

SUMMARY OF THE INVENTION

The present invention provides a spiral wound fiber can in which the body of the can comprises a layer made, for example, of kraft paper or a relatively heavy fiberboard base lined within by an oil and moisture impermeable barrier formed, for example, from a laminate of aluminum foil and paper. The body layer includes a helically extending separation line or butt joint bonded together by a reinforcing tensile element in the form of a reinforcing strip. The liner has a peelable or separable adhesive joint between its helically extending edges that is aligned with and underlies the butt joint so that the butt joint will open and the edges of the liner peel away from one another when the reinforcing strip is removed. A discrete label preferably covers the reinforcing strip and is bonded to the body layer by at least two broken or unbroken bands of adhesive on opposite sides of the reinforcing strip. In a preferred form of the invention, a circumferentially extending collar cut is made through the label and the reinforcing strip to facilitate their removal. The reinforcing strip is preferably bonded more strongly to the label than to the body and is removed when the label is removed thereby weakening the can enough that it will open without being struck against a hard object.

DESCRIPTION OF THE PREFERRED EMBODIMENT

A winding mandrel of standard construction is provided with the usual winder W having a belt or the like entrained over the mandrel for drawing the various webs including the bodystock layer 2 onto the mandrel as a spiral or helix. The bodystock sheet 2 and liner 5 are wound continuously onto the mandrel and travel from left to right in the figures thereby forming a helically extending butt joint 7 where the adjacent convolutions of the bodystock 2 contact one another. Over the butt joint 7 is wrapped a reinforcing tape 6 which can be thought of as a tensile member. The tensile member is adhered to the bodystock by means of adhesive 6*a* suitably applied to the strip 6 just before winding. In the winding operation the strip 6 is important in providing the freshly made tube with sufficient initial strength to prevent what is known as a blow-up, in which all of the coils being wound on the machine suddenly fly apart. The liner 5 which is formed from a relatively tough barrier material such as the composite of kraft paper and aluminum foil is applied to the mandrel and wound inside the bodystock 2 with adhesive applied to the bodystock to bond the liner in place.

As shown best in FIG. 4, the liner 5 is bonded to itself along its marginal helically extending edges 5*a* and 5*b* along a seam underlying and adjacent to the butt joint 7. The seam or joint is formed by folding the edge 5*a* outwardly at 5*c* against itself to define a hem or lap 5*d* that may be on the order of a quarter of an inch wide and thereafter bonding the overlapping edges 5*b* and 5*d* of liner to one another with a suitable adhesive 9 such as a heat sealable lacquer e.g. a polyvinyl chloride lacquer to provide a rupturable joint formed by the lapped edges adjacent to and underlying the butt joint 7. The peelable joint in the liner provides substantially no strength at the butt joint.

During opening, as will be described below, the butt joint 7 separates and the liner seam produced by the adhesive 9 peels open as stress is placed on it. The liner may, therefor, be thought of as a peelable joint. With the liner joint adjacent to and under the butt joint 7, the can will peel open automatically after the reinforcing strip 6 is removed along with the label 4 when the can contains dough under pressure primarily as a result of the expansion of the dough contained in the can. The peeling open of the liner seam usually takes place without making much if any noise within a second or so after removal of the label and reinforcing strip 6. It can be seen that the opening of the can is substantially automatic following removal of the label and reinforcing strip but the reinforcing strip which can be as strong as needed provides the requisite strength to prevent the cans from popping open during shipment.

After the tensile member 6 has been bonded over the outside of the butt joint 7, a label 4 which functions as a protective coating and printing surface is applied and bonded by adhesive 4*b* suitably applied to the lower surface of the label. A portion of this adhesive 6*b* (FIG. 3) bonds the label to the tape 6 to provide a bond which is stronger than the adhesive layer 6*a* so that the manual removal of the label also removes the strip 6. Thus, the can is opened in a single manipulative step. While not the preferred embodiment, if the bond 6*a* is made stronger than 6*b* or no adhesive is provided at 6*b*, the can will open in two manipulative steps, viz. by first removing the label then grasping and peeling away strip 6.

After the tube has been completely formed, it is cut into can lengths as shown by dotted lines 3. The tube is then cut circumferentially only partially through its thickness, specifically through the label 4 and the tensile element 6 along collar cut C. The cut C does not extend through the bodystock layer 2 and is located relatively close to one end of the container, normally about one half of an inch from one end. By "relatively close to the end" is meant that the collar cut should be placed preferably no more than about one half an inch from the end of the container but it is possible to place the cut C even further from the end of the can which is now ready for filling and capping.

The finished package embodying the present invention is thus comprised of an elongated cylindrical container body. The butt joint 7 extends generally longitudinally and helically of the can. The inner protective liner formed from flexible sheet material is positioned adjacent and bonded to the inner wall of the body layer to help prevent the loss of moisture and oil from the can. The label 4 is positioned adjacent to the outer surface of the body layer 2, provides a printing surface and prevents ambient moisture from harming the container body and its contents. The tensile member 6 bridges the butt joint 7 and is adhered to the marginal edges of the body strip 2 adjacent and on either side of the butt joint by a suitable adhesive such as a resin emulstion or hot melt adhesive 6*a*.

The bottom cap 14 is normally applied before filling. After the container is filled with dough products, the cover 12 is secured to the top. The bottom covers are secured in place conventionally by crimping or seaming with commercially available equipment.

As seen in FIGS. 2, 3 and 4, the body member 2 is relatively thick compared with the liner and the label. It can consist of heavy scrap news coated cylinderboard, for example, .026 inches in thickness or kraft paper and functions as a stiffening member to provide shape, thickness, and overall strength. If the bodystock sheet 2 comprises kraft paper it should be coated in the location of the reinforcing strip 6 with a releasing material such as wax, clay or a layer of weak adhesive. The liner 5 consists, for example, of 25 pounds per 3000 feet square kraft paper outside laminated to 0.00035 inch thick aluminum foil. The liner 5 is bonded to the core 2 by means of adhesive 5*e* with the seam aligned under the butt joint 7. An adhesive free area 5*f* is provided between the seam and the body stock. The butt joint is able to open easily after the removal of the label and tensile member 6 as will be described below.

The label 4, since it need not provide the tensile requirements for bonding together the butt joint 7, can be formed from any relatively light weight sheet material especially welladapted as a printing surface. It can, for example, be formed from any suitable flexible sheet material such as laminates of paper and foil as mentioned above but can be of other construction such as 45–55 pounds per ream clay coated bleached kraft either supercalendered or machine glazed.

Both the outer and inner surfaces of the tensile member 6 are preferably adhesively bonded to the adjacent material. An important feature of the invention is the provision of differential bonding strength on the inner and outer surfaces of the strip 6 with the bond between the strip 6 and the label being stronger than that between it and the bodystock layer 2. The tensile member 6 is thus removed when the label 4 is removed. In a typical application of the invention, the bodystock will have a surface composed of a relatively short scrap news fiber so that when the label 4 is lifted, most or all of the rupturing will take place within the bodystock itself. The tensile member 6 can be about one half inch or more (typically 1 inch) in width and can be formed, for example, from kraft paper of 25 pounds per ream. The strip 6 is highly receptive to glue on its outer surface. By the term "glue receptive" as used herein, is meant surfaces free from a coating which would render them poorly adherent to glue. Similarly the term "poorly adherent" means that the natural ability of the paper to be glued is reduced.

The label 4 can be relatively light in construction compared to the normal label. For example, excellent results are accomplished with a foil and kraft paper label as light as 25 pounds per ream representing a saving of about 0.75 to 1.0 cents per 1000 square inches compared with the current cost of an ordinary label. Since the tensile function is provided by strip 6, the label can be formed from practically any material.

The label 4 thus serves only as an oil and moisture barrier and as a surface for printed indicia 4*a* but does not provide major support to butt joint 7 since this purpose is fulfilled by the tensile element 6. Since the bond strength differential causes the tensile element 6 to separate from the bodystock 2, as soon as the label is withdrawn the can will open along the butt joint as soon as the strip 6 is removed.

The label 4 is bonded to the body 2 by two adhesive strips 15 and 16 in addition to being bonded to the tensile member 6. The extreme edges 22 of the label 4 are almost free from adhesive. This is accomplished, for example, by scraping them almost free from adhesive just before the label is wound into tubular form so that the underlying unglued edge 22 about an eighth of an inch wide or so and the overlying adhesive free edge 22 is about 3/32 of an inch wide. A glazed area 26 appears adjacent adhesive free band 24 where one edge overlies the opposite edge. The slight amount of adhesive present prevents the tab T from flagging out when the cans are made.

The filled container appears as shown in FIG. 3. To open the container, one grasps the edge of the label, the adhesive free margin 24 of the label edge adjacent the collar cut C which functions as a tab T and withdraws the label as shown in FIG. 2. As this is done, the reinforcing strip or tensile member 6 is also removed since the bond 6*b* has greater strength than the bond 6*a* between the tensile member 6 and the body material 2. The can then opens by itself along butt joint 7 as the dough pressure peels the edge 5*d* from edge 5*b* of the liner. If the dough is not under pressure one simply grasps the ends of the can and rotate them in opposite directions whereupon the can opens without resistance as the bonded edges of the liner peel apart.

It can thus be seen that the can will open using a single manipulative step and that it is consequently unnecessary to strike it against a solid object such as a table to open it. The peelable joint between the edges of the liner is so weak that the container is self opening following removal of the label and reinforcing strip when pressurized dough is inside. However, if the dough is not under pressure or is under very low pressure, the can can be easily opened by simply twisting the ends in opposite directions and the bonded edges of the liner offer such little resistance that the container can be opened with just about the same amount of force required when no liner at all is used. It will also be seen that the label can be formed from a lighter weight and less expensive material and yet the cans are equal or greater in strength than those now in commerical use during the shipment and storage period. In addition, the container can be readily manufactured on existing equipment and the strength provided by the reinforcing strip prevents the freshly formed tube from twisting apart or blowing up during the manufacturing operation which is more likely to happen than in an ordinary can because the liner provides little, if any, strength at the butt joint.

What is claimed is:

1. A spirally wound composite cylindrical can adapted to open by removal of a reinforcing strip and having a discrete label and reinforcing element, said can comprising a spirally wound bodystock sheet having a pair of side edges and a butt joint between the adjacent side edges thereof, the butt joint extending generally spirally of the can, a liner composed of flexible sheet material bonded to the bodystock sheet and having a seam underlying the butt joint, and being adjacent thereto and extending spirally of the can so as to be coextensive with the butt joint, the seam between the edges of the liner being rupturable and peelable and including an inner lap and an outer lap adjacent thereto, one of said laps being folded in the direction of the other lap to form a hem and said hem being adhesively bonded to the other lap to define said peelable joint, the peelable joint aligned with the butt joint providing substantially no strength at the butt joint, a tensile element comprising a reinforcing strip removably adhesively bonded to the outer surface of the bodystock sheet over the butt joint, and the adhesive bond between the reinforcing strip and the bodystock being rupturable and serving to hold the adjacent edges of the butt joint together prior to removal of the reinforcing strip, a label formed from flexible sheet material removably bonded to the outer surface of the bodystock sheet whereby removal of the reinforcing strip allows the can to easily open with the application of little if any externally applied force.

2. The can of claim 1 wherein the label is also bonded to the outer surface of the reinforcing strip and the bond between the label and the reinforcing strip is stronger than the bond between the reinforcing strip and the body whereby removal of the label will also remove the reinforcing strip.

3. The container of claim 1 wherein the reinforcing strip is kraft paper adhesively bonded on each of its surfaces to overlying and underlying layers of sheet material.

4. The container of claim 1 wherein the hem is about a quarter of an inch wide and is substantially aligned under the butt joint.

5. The can of claim 1 wherein end members are bonded to each end of the can.

6. The can of claim 1 wherein a collar cut is made through the label and tensile element, the cut positioned relatively close to one end of the container, the bond between the reinforcing strip and the label is stronger than the bond between the reinforcing strip and the bodystock whereby removal of the label will also remove the reinforcing strip, and the reinforcing strip is adhesively bonded on each of its surfaces to overlying and underlying layers of sheet material.

7. The can of claim 6 wherein the seam in the liner includes a folded hem about a quarter of an inch wide aligned substantially under the butt joint and an end member is secured to at least one end of the can.

8. The can of claim 1 wherein there is an adhesive-free area between said seam and said butt joint.

9. The can of claim 8 wherein the liner is a laminate of paper and metal foil.

10. The can of claim 8 wherein the tensile element comprises a flexible sheet of material having a cellulosic base that is highly receptive to glue on its outer surface, the tensile element is bonded to the label, extends from one end of the can to the other and has a cut therethrough to facilitate removal of said tensile element.

* * * * *